US005249499A

United States Patent [19]

Goldstein et al.

[11] Patent Number: 5,249,499

[45] Date of Patent: Oct. 5, 1993

[54] ADJUSTABLE TUNING BARREL

[76] Inventors: Bradley Goldstein, 110 Longwood Ave., Brookline, Mass. 02146; Martin Goldstein, 87-10 204th St., Apt. A-28, Hollis, N.Y. 11423

[21] Appl. No.: 670,707

[22] Filed: Mar. 18, 1991

[51] Int. Cl.[5] ..... G10D 9/00

[52] U.S. Cl. ..... 84/386

[58] Field of Search ..... 84/382, 380 R, 386, 84/383 R, 383 A

[56] References Cited

U.S. PATENT DOCUMENTS

| | | | |
|---|---|---|---|
| 1,171,647 | 2/1916 | Reynolds | 84/386 |
| 2,485,021 | 5/1946 | Strupe | 84/386 |
| 2,802,387 | 8/1957 | Bushnell | 84/386 |
| 3,438,298 | 11/1967 | Thompson | 84/380 R |
| 3,800,651 | 4/1974 | Small | 84/386 |
| 4,754,682 | 7/1988 | Getzen | 84/382 |
| 5,063,276 | 11/1991 | Woodard | 200/529 |

*Primary Examiner*—Michael L. Gellner
*Assistant Examiner*—Cassandra C. Spyrou
*Attorney, Agent, or Firm*—Russel D. Weinzimmer

[57] ABSTRACT

An adjustable tuning barrel is disclosed for use with a woodwind instrument that allows the instrument to be easily tuned during play. The tuning barrel includes a fixed element, an adjusting ring coaxial with the fixed element and held in rotatable contacting relationship therewith, and an extending element in rotatable and threaded relationship with the adjusting ring, and in rotatable and motionally resisting relationship with the fixed element. The adjusting ring is wide enough to be comfortably located and manipulated during play. The fixed and extending elements are adapted to facilitate thermal exchange with the ambient environment.

16 Claims, 2 Drawing Sheets

ADJUSTABLE TUNING BARREL

FIELD OF THE INVENTION

This invention relates to to woodwind instruments, and particularly to tuning barrels for use therewith.

BACKGROUND OF THE INVENTION

A woodwind instrument, such as a clarinet, includes a mouthpiece section, a barrel section and a bell section. The pitch of the instrument can be lowered by moving the mouthpiece section away from the barrel section, thereby lengthening an air column within the instrument. The pitch of the instrument changes in response to ambient temperature and humidity, and to heat and moisture introduced by a player's breath. Although thermally induced changes in pitch can sometimes be compensated for by manually shifting the position that the mouthpiece is seated within the barrel, this maneuver is cumbersome, and therefore cannot be accomplished while playing the instrument. It is very inconvenient and disruptive to interrupt a musical piece to affect this adjustment. Furthermore, since thermally induced pitch changes are slight, but nevertheless perceptible, the adjustment of the mouthpiece with respect to the barrel must also be made precisely. This can be difficult, because the same properties that allow the mouthpiece to remain lodged within the barrel prevent smooth, precise adjustments.

A tuning barrel can facilitate this adjustment. The tuning barrel is included between the mouthpiece and the main body of the woodwind instrument. Tuning barrels and the like are well known in the art. However, known devices cannot be adjusted easily during play, and do not lend themselves to precise pitch adjustments. Furthermore, some tuning barrels do not allow the mouthpiece to be rotated with respect to the main barrel section, and some barrels themselves have poor thermal expansion properties and less than satisfactory vibratory responses. Moreover, early models are difficult to manufacture.

In particular, Bushnell U.S. Pat. No. 2,802,387 teaches a tuning device for musical instruments that includes a set screw for locking a tuning section in a selected position with respect to a barrel section, and for providing a desired telescopic adjustment. Bushnell lacks any threading between the tuning section and the barrel section, and therefore is not capable of the degree of precision adjustment that such threading facilitates. Additionally, adjustment of the set screw is difficult to accomplish during play.

Also, Reynolds U.S. Pat. No. 1,171,647 discloses a tuning slide for clarinets that includes an off-axis guide pin that serves to prevent turning of the mouthpiece of the clarinet with respect to its body upon adjusting the slide tube when tuning the clarinet. Furthermore, Reynolds depicts an adjusting ring of such thinness that the extent of overlap between the threads on a slide tube is consistently insufficient to provide lateral stability with respect to the central axis of symmetry unless the guide pin is also present to provide such stability. However, it is known in the art that it would be desirable if it were possible to both rotate the mouthpiece with respect to the body of a clarinet, or other woodwind instrument, and precisely adjust the length of a tuning barrel incorporated therein. Also, a thin adjusting ring is awkward to locate and uncomfortable to adjust. Furthermore, because most of the metal parts are not exposed, being covered in ebonite, the thermal dissipation properties of Reynolds's device are inadequate to provide satisfactory thermal properties.

SUMMARY OF THE INVENTION

An adjustable tuning barrel is disclosed for use with a woodwind instrument that allows the instrument to be easily tuned during play. The tuning barrel includes a fixed element, an adjusting ring coaxial with the fixed element and held in rotatable contacting relationship therewith, and an extending element in rotatable and threaded relationship with the adjusting ring, and in rotatable and motionally resisting relationship with the fixed element. The adjusting ring is wide enough to be comfortably located and manipulated during play. The fixed and extending elements are adapted to facilitate thermal exchange with the ambient environment. Controlled thermal exchange can reduce the need to adjust the tuning barrel during play.

Nevertheless, as ambient temperature and humidity change the tuning of the instrument, the tuning barrel is infinitely and precisely adjustable to compensate for such changes. Moreover, both ends can be rotated coaxially as necessary for positioning the instrument body relative to the mouthpiece, and this action is easily performed while the instrument is being played. Furthermore, the adjusting ring is wide, thereby making tactile location while playing easy. In a preferred embodiment, the tuning barrel is made of aluminum. Aluminum is not effected by humidity and it has excellent heat conduction and dissipation properties, as well as resonance enhancing qualities. Other materials which offer the above characteristics and benefits are ceramics, brass, and plastics. Additionally, since the extending element can be displaced over a distance that encompasses the displacements represented by all currently available fixed length tuning barrels, the tuning barrel of the invention can replace a variety of lengths of fixed length tuning barrels. Moreover, the adjustable tuning barrel provides ease of manufacture and assembly, and disassembles for easy cleaning.

DESCRIPTION OF THE DRAWING

The invention will be more fully understood from the following detailed description, in conjunction with the accompanying figures, in which.

DETAILED DESCRIPTION OF THE PREFERRED EMBODIMENT

Figure 1:
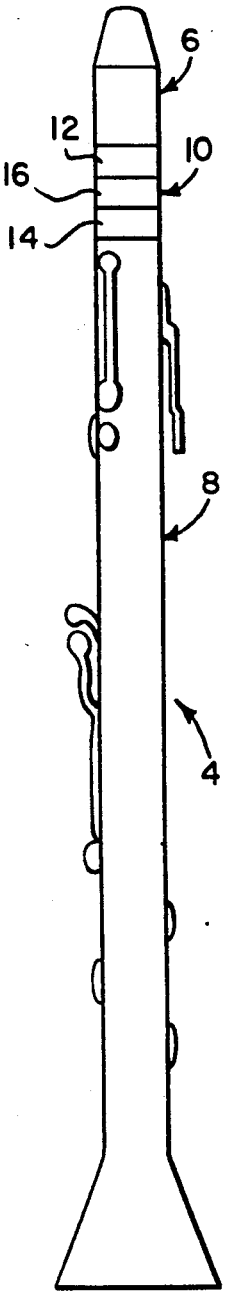
FIG. 1 is a pictorial view of an exemplary woodwind instrument.

With reference to FIG. 1, an exemplary woodwind instrument, such as a clarinet 4, includes a mouthpiece 6, an instrument body 8 and an adjustable tuning barrel of the invention 10.

Figure 2:
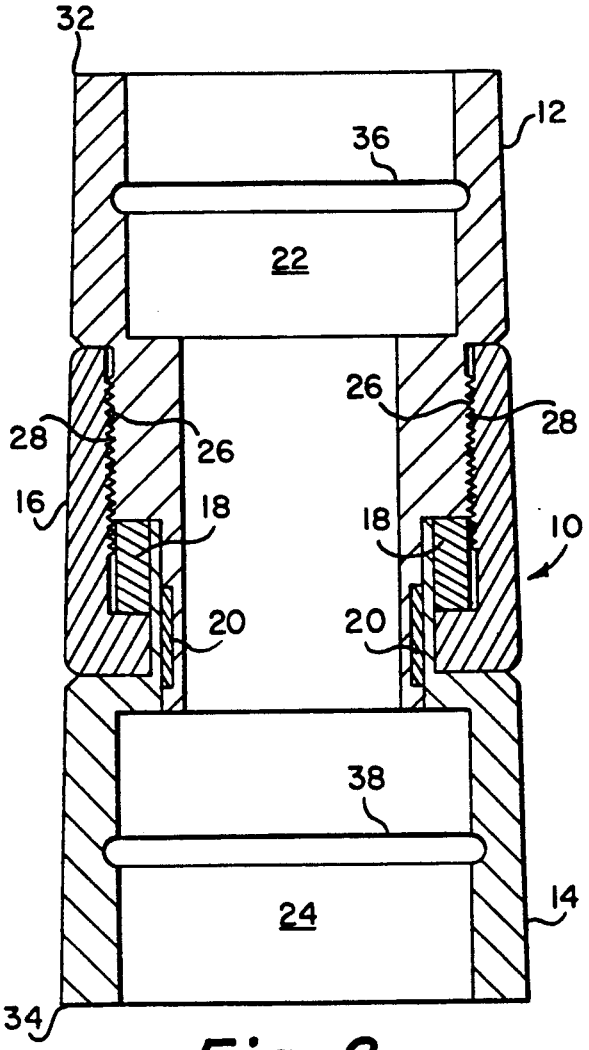
FIG. 2 is a cross-sectional view of an embodiment of the tuning barrel of the invention in its fully retracted position.
Figure 3:
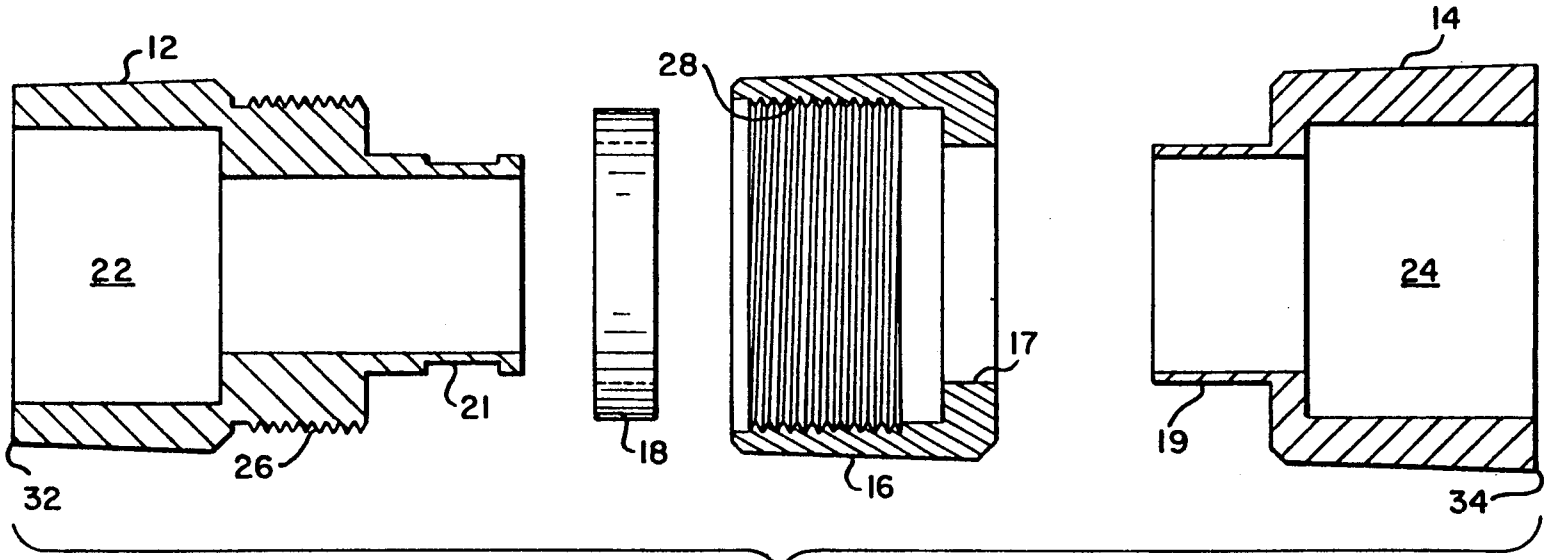
FIG. 3 is an exploded cross-sectional view of the embodiment of FIG. 2.

Referring to FIGS. 2 and 3, the adjustable tuning barrel 10 includes an extending element 12, a fixed element 14, and an adjusting ring 16. A neck 19 of the fixed element 14 extends through an opening 17 of the adjusting ring 16, and is press fit within a retaining ring 18. The retaining ring 18 serves to maintain the fixed element 14 in sliding contact with the adjusting ring 16 throughout any rotational motion of the ring 16 with respect to the element 14. Accordingly, the retaining ring 18 is preferably press fit at a distance along the neck 19 such that rotational motion of the adjusting ring 16 with respect to the fixed element 14 is not restricted.

The extending element 12 includes a threaded portion 26 that is engaged with a complementary threaded portion 28 of the adjusting ring 16. In a minimum extension position, shown in FIG. 2, the threaded portions 26 and 28 exhibit a maximum extent of overlap. Rotating the adjusting ring 16 with respect to the extending element 12 will reduce the extent of overlap of the threaded portions 26 and 28, and will consequently displace the extending element 12 axially and away from the adjusting ring 16 to an extent determined by a threads per inch parameter of the threaded portions 26 and 28. In the preferred embodiment, the threaded portions 26 and 28 each have twenty-eight threads per inch. One skilled in the art will recognize that the function of the cooperative threaded portions 26 and 28 can also be performed, for example, by a cooperative pin and helical track mechanism.

The adjusting ring 16 is of a width along its axis of symmetry such that it presents a gripping surface sufficient to contact most of the bulb of a player's finger. In a preferred embodiment, the adjusting ring is of a width that extends more than 20% of the length of the tuning barrel along the axis of symmetry of the tuning barrel. (The bulb of a finger is the portion used to take finger prints.) Also, in the preferred embodiment, the outer surface of the adjusting ring 16 is finely knurled to provide an enhanced surface for manual manipulation. Furthermore, the knurled surface can be easily located without the need to remove the instrument 4 from playing position.

Figure 4:
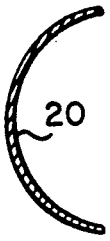
FIG. 4 is a cross-sectional view of a breaking spring.

A breaking spring 20, a side view of which is shown in FIG. 4, is seated in a spring retaining channel 21 of the extending element 12. The breaking spring 20 is of a curvature that is greater than the curvature of the channel 21. Consequently, one or more portions of the spring 20 press against the inner wall of the neck 19, thereby providing frictional deterrence against undesirable free rotational motion of the extending element 12 with respect to the fixed element 14. Additionally, the pressing action of the spring 20 provides a frictional resistance to axial displacement of the extending element 12 that accompany any rotational motion of the adjusting ring 16 due to the cooperative threaded surfaces 26 and 28, thereby attenuating rotational motion of the adjusting ring 16. The breaking spring 20 is constructed of a material with spring-like qualities, such as standard spring steel, and is of a width to fit within the spring retaining channel 21.

The mouthpiece mating section 22 of the extending element 12 is adapted to receive a mating section of any standard clarinet-type mouthpiece. In one preferred embodiment, shown in FIG. 2, at least one O-ring channel 36 is provided for seating an O-ring, not shown. The O-ring cooperates with an inner wall of the mating section 22 to provide an air-tight seal. In an alternate embodiment, shown in FIG. 3, a smooth inner surface of the mating section 22 cooperates with one or more O-rings or a cork seal of a clarinet-type mouthpiece. The circumference of the barrel end 32 most proximal to the mouthpiece is substantially the same as the circumference of the back end of a standard mouthpiece.

The mouthpiece mating section 24 of the fixed element 14 is adapted to receive a mating section of any standard clarinet-type instrument body. In one preferred embodiment, shown in FIG. 2, at least one O-ring channel 38 is provided for seating an O-ring, not shown. The O-ring cooperates with an inner wall of the mating section 24 to provide an air-tight seal. In an alternate embodiment, shown in FIG. 3, a smooth inner surface of the mating section 24 cooperates with a sealing section of a clarinet-type instrument body. The circumference of the barrel end 34 most proximal to the instrument body is substantially the same as the circumference of the portion of the instrument body that abuts the tuning barrel 10.

The tuning barrel 10 is preferably made of a material that is lightweight, has good heat dissipation properties, and does not introduce acoustical damping effects. Preferred materials include aluminum, brass, ceramic, a graphite composite, or a polymer material. A preferred embodiment employs 7075 aluminum for all assembly constituents except the tension spring In an alternate preferred embodiment, the adjusting ring is made of a non-metallic material, such as plastic, to reduce the extent of metal-to-metal surface contact, and to provide a smoother turning action.

To tune the instrument or adjust its pitch, a player rotates the adjusting ring 16. Clockwise rotation of the adjusting ring 16 effectively lengthens the barrel, thereby increasing the overall length of the instrument, and consequently lowering its pitch. Analogously, counter-clockwise rotation of the adjusting ring 16 raises the pitch of the instrument. Furthermore, when in playing position, the fixed element 14 and the extending element 12 may be rotated about the central longitudinal axis in relation to one another, thereby easing rotational adjustment of mouthpiece in to the instrument body. The extending and fixed elements are adapted to facilitate thermal exchange with the ambient environment. In particular, both the fixed element and the extending element expose at least 20% of their outer surface for thermal exchange with the ambient environment.

Other modifications and implementations will occur to those skilled in the art without departing from the spirit and the scope of the invention as claimed. Accordingly, the above description is not intended to limit the invention except as indicated in the following claims.

What is claimed is:

1. An adjustable tuning barrel for use with a woodwind instrument including a mouthpiece and an instrument body, said tuning barrel comprising:

an adjusting ring, freely rotatable about its axis of symmetry, said ring including:

first flange means; and first thread means disposed on an inner surface of said adjusting ring;

a fixed element fixable with respect to the body of said woodwind instrument, said fixed element including:

second flange means, cooperative with said first flange means, for retaining said adjusting ring in rotatably contacting relationship with said fixed element; and first mating means for attaching said tuning barrel to said body of said woodwind instrument; and an extending element freely rotatable about its axis of symmetry, said extending element including:

second thread means disposed on an outer surface of said extending element for threadably engaging said first thread means of said adjusting ring so as to cause said extending element to move coaxially toward or away from said instrument body in response to rotation of said adjusting ring;

second mating means for attaching said tuning barrel to the mouthpiece of a woodwind instrument; and a rotation impeder for resisting and permitting rotational and coaxial movement of said extending element with respect to said fixed element, being disposed between and in contact with an inner surface of said fixed element and an outer surface of said extending element.

2. The adjustable tuning barrel of claim 1 wherein said fixed element further includes a neck that extends coaxially through an opening of the adjusting ring, and wherein said first flange means consists of a retaining ring disposed within said adjusting ring and press fit about said neck.

3. The adjustable tuning barrel of claim 1 wherein said first and second thread means each includes a threaded portion having approximately twenty-eight threads per inch.

4. The adjustable tuning barrel of claim 1 wherein said gripping surface of said adjusting ring is finely knurled to provide an enhanced surface for manual manipulation.

5. The adjustable tuning barrel of claim 1 wherein said outer surface of said extending element also including a spring retaining channel, and said rotational impedance means is a breaking spring disposed in said spring retaining channel.

6. The adjustable tuning barrel of claim 5 wherein the channel having a curvature and the breaking spring is of a curvature that is greater than said curvature of the channel.

7. The adjustable tuning barrel of claim 1 wherein said mating means of said extending element further includes at least one O-ring channel for seating an O-ring, the O-ring for cooperating with an inner wall of the mating section and the mouthpiece to provide an air-tight seal.

8. The adjustable tuning barrel of claim 1 wherein said extending element, said adjusting ring, and said fixed element are each made of a material that is lightweight, has good heat dissipation properties, and does not introduce acoustical damping effects.

9. The adjustable tuning barrel of claim 8, wherein the material is selected from the group consisting of aluminum, brass, ceramic, graphite composite, and polymer material.

10. The adjustable tuning barrel of claim 1 wherein the adjusting ring is made of a non-metallic material, such as plastic, to reduce the extent of metal-to-metal surface contact, and to provide a smoother turning action.

11. The adjustable tuning barrel of claim 1 wherein both said fixed element and said extending element expose at least 20% of their outer surface for thermal exchange with the ambient environment.

12. An adjustable tuning barrel for use with a woodwind instrument including a mouthpiece and an instrument body, said tuning barrel comprising:

a fixed element, connectable to said instrument body at a distal end, and with a flange at a proximal end;

an adjusting ring coaxial with said fixed element, and held in rotatable contacting relationship with said fixed element;

an extending element in rotatable and threaded relationship with said adjusting ring, and in rotatable relationship with said fixed element; and a motion resistance element disposed between and in contact with an inner surface of said fixed element and an outer surface of said extending element, for providing frictional deterrence against rotational motion of the extending element with respect to the fixed element, while permitting such motion.

13. The adjustable tuning barrel of claim 12 wherein said adjusting ring is of a width that extends more than 20% of the length of said tuning barrel along the axis of symmetry of said tuning barrel.

14. The adjustable tuning barrel of claim 12 wherein said motion resistance element is a breaking spring.

15. The adjustable tuning barrel of claim 12 wherein said fixed element and said extending element each include mating means with at least one O-ring channel for seating an O-ring, the O-ring being for cooperation with an inner wall of the mating means and a mouthpiece to provide an air-tight seal.

16. An adjustable tuning barrel for use with a woodwind instrument including a mouthpiece and an instrument body, said tuning barrel comprising:

a fixed element, connectable to said instrument body at a distal end, and with a flange at a proximal end;

an adjusting ring coaxial with said fixed element and held in rotatable contacting relationship with said fixed element;

an extending element in rotatable and longitudinally advancing relationship with said adjusting ring and said fixed element along an axis of symmetry; and a motion resistance element disposed between and in contact with an inner surface of said fixed element and an outer surface of said extending element, for providing frictional deterrence against rotational motion of the extending element with respect to the fixed element, while permitting such motion.

* * * * *